US006100909A

United States Patent [19]

Haas et al.

[11] Patent Number: 6,100,909

[45] Date of Patent: Aug. 8, 2000

[54] MATRIX ADDRESSABLE ARRAY FOR DIGITAL XEROGRAPHY

[75] Inventors: Werner E. Haas, Webster; Joel A. Kubby, Rochester, both of N.Y.

[73] Assignee: Xerox Corporation, Stamford, Conn.

[21] Appl. No.: 09/032,923

[22] Filed: Mar. 2, 1998

[51] Int. Cl.[7] ..... B41J 2/39; B41J 2/395

[52] U.S. Cl. ..... 347/141; 347/112

[58] Field of Search ..... 347/112, 120, 347/128, 141, 142, 148, 55

[56] References Cited

U.S. PATENT DOCUMENTS

| | | | |
|---|---|---|---|
| 4,078,929 | 3/1978 | Gundlach . | |
| 4,448,867 | 5/1984 | Ohkubo et al. | 347/55 X |
| 4,588,997 | 5/1986 | Tuan et al. . | |
| 4,620,203 | 10/1986 | Nakatani et al. | 347/112 |
| 4,748,464 | 5/1988 | Pannekoek et al. | 347/141 |
| 4,757,343 | 7/1988 | Nakatani et al. | 347/142 |
| 4,998,146 | 3/1991 | Hack . | |
| 5,640,189 | 6/1997 | Ohno et al. | 347/141 |

OTHER PUBLICATIONS

W.E. Haas, D.G. Parker and H.M. Stark, Highlight Color Printing: The Start of a New Machine, vol. 36, No. 4, Jul./Aug. 1992, pp. 366–372.

Russel A. Martin, Victor M. Da Costa, Michael Hack and John G. Shaw, High–Voltage Amorphous Silicon Thin–Film Transistors, IEEE Transactions on Electron Devices, vol. 40, No. 3, Mar. 1993, pp. 634–644.

Patrick A. O'Connell, Richard Gable and Clifford Brown, Amorphous Silicon Technology—Bringing a New Level of Integration and Image Quality to Electrostatic Printing, pp. 1–4.

*Primary Examiner*—Sandra Brase
*Attorney, Agent, or Firm*—John M. Kelly

[57] ABSTRACT

An apparatus for forming an image comprising a substrate with a plurality of high voltage transistors on the substrate. The transistors include a source electrode, a drain electrode and a gate electrode. Each transistor switches a marking potential of several hundred volts between the source and drain by a gate potential of at least an order of magnitude lower than the source to drain potential. There are a plurality of high voltage capacitors on the substrate. One of each capacitor is connected to one of the drain electrodes and each capacitor stores a charge potential approximately equal to the marking potential. The charge potential on each capacitor controls the forming of the image. A first data input on the substrate selectively loads a gate potential on gate the electrodes. A second data input located on the periphery of the substrate selectively loads a source potential on the source electrodes. The high voltage capacitors, the high voltage transistors, and the first data input are thin film elements integrally formed on the substrate.

16 Claims, 7 Drawing Sheets

MATRIX ADDRESSABLE ARRAY FOR DIGITAL XEROGRAPHY

FIELD OF THE INVENTION

This invention concerns high voltage thin film capacitors useful for the production of a latent image.

BACKGROUND OF THE INVENTION

In a typical electrophotographic process a portion of a photoconductive member known as a photoreceptor is charged by a corona device to a substantially uniform potential. The charged portion is then exposed to a light pattern of an original image to selectively discharge the photoreceptor in accordance with the light pattern. The resulting pattern of charged and discharged areas form a charge pattern known as a latent image. That latent image is developed by contacting it with toner, the toner bring attracted to the image areas and held thereon by the electrostatic charge on the photoreceptor. Thus, a toner image is produced in conformity with a light pattern. The toner image is then transferred and fixed to a copy media to form a permanent record of the image. After development, any toner left on the photoreceptor is cleaned from its surface.

The foregoing discussion generally describes a typical black and white printing process. The approach utilized for multicolor electrophotographic printing is substantially the same. However, instead of forming a single latent image on the photoreceptor multiple latent images corresponding to different color separations are recorded on the photoreceptor. Each single color latent image is then developed with a toner complimentary thereto. The process is repeated for each of the images. Thereafter, the composite color image is transferred and fixed to a substrate to form a multi-layered toner image.

There are several disadvantages associated with using a photoreceptor in the electrophotographic printing process. First, once the photoreceptor surface is charged, the surface potential can only be decreased from its initial potential by discharge, making feedback correction for gray scaling and color balance difficult. Secondly, the photoreceptor cannot be used to produce a time-varying latent image, which may be useful in eliminating time dependent changes in the charge. Such time dependent changes cause higher spatial frequency components of an image to develop faster than lower frequency components. An ability to produce a time-varying latent image be useful for dry powder development to break down clusters of toner particles by spatially shifting the latent image periodically. Thirdly, the fibers on a cleaning brush that removes excess toner from the photoreceptor can easily scratch the photoreceptor surface so as to impair the copy quality of the developed image. When this happens, the operating lifetime of the photoreceptor is reduced.

Therefore, it is desirable to have a technique for performing electrophotographic printing without exposing a charged photoreceptor. Even more beneficial would be an electrophotographic printing technique that readily enables the control of the charge of a latent image.

The following disclosures may relate to various aspects of the present invention.

U.S. Pat. No. 4,588,997
Patentee: Tuan et al.
Issue Date: May 13, 1986

U.S. Pat. No. 4,998,146
Patentee: Hack
Issue Date: Mar. 5, 1991

The disclosures of the above-identified patents may be briefly summarized as follows:

U.S. Pat. No. 4,588,997 to Tuan et al. discloses an electrographic writing head that places continuous marks on a recording medium in response to a high voltage applied to selected writing styluses. The writing head includes a substrate upon which the stylus electrodes, multiplexed driver circuitry and active devices are integrally fabricated by thin film deposition techniques. For each stylus, there is provided a high voltage thin film transistor and a latching circuit for holding the state of the high voltage transistor for substantially an entire line writing time.

U.S. Pat. No. 4,998,146 to Hack discloses a high voltage thin film transistor having a charge transport layer. Source and drain electrodes are laterally spaced from one another and each is in a low electrical resistance contact with the charge transport layer. A gate electrode spaced normally from the source and drain electrodes extends laterally with one edge in the vicinity of the source electrode and an opposite edge located between the source and drain electrodes. A gate dielectric layer separates the gate electrode from the source and drain electrodes and the charge transport layer, in the normal direction wherein the gate electrode and the source and the drain electrodes are located on the same side of the charge transport layer.

SUMMARY OF THE INVENTION

One aspect of the present invention is an apparatus for forming an image. That apparatus comprises a substrate having a plurality of high voltage transistors. Each high voltage transistor includes a source electrode, a drain electrode, and a gate electrode. The transistors switch a marking potential of several hundred volts between the source and the drain by a gate potential that is at least an order of magnitude lower than the source to drain potential. The apparatus further includes a plurality of high voltage capacitors on the substrate with each high voltage capacitor connected to one of the drain electrodes. Each high voltage capacitor stores a charge potential approximately equal to the marking potential. A first data input on the substrate selectively loads a gate potential on the gate electrodes. A second data input located on the periphery of the substrate selectively loads a source potential on the source electrodes. The high voltage capacitors, the high voltage transistors, and the first data input beneficially are thin film elements integrally formed on the substrate.

Another aspect of the present invention is a printing system for forming an image. The printing system comprises a substrate having a plurality of high voltage transistors. Each high voltage transistor includes a source electrode, a drain electrode, and a gate electrode that switch a marking potential of several hundred volts between the source and the drain by a gate potential of at least an order of magnitude lower than the source to drain potential. The apparatus further includes a plurality of high voltage capacitors on the substrate with each high voltage capacitor connected to one of the drain electrodes. Each high voltage capacitor stores a charge potential approximately equal to the marking potential. A first data input on the substrate selectively loads a gate potential on the gate electrodes. A second data input located on the periphery of the substrate selectively loads a source potential on the source electrodes. The high voltage capacitors, the high voltage transistors, and the first data input beneficially are thin film elements integrally formed on the substrate.

BRIEF DESCRIPTION OF THE DRAWINGS

Other features of the present invention will become apparent as the following description proceeds and upon reference to the drawings, in which.

DETAILED DESCRIPTION OF THE INVENTION

Figure 1:
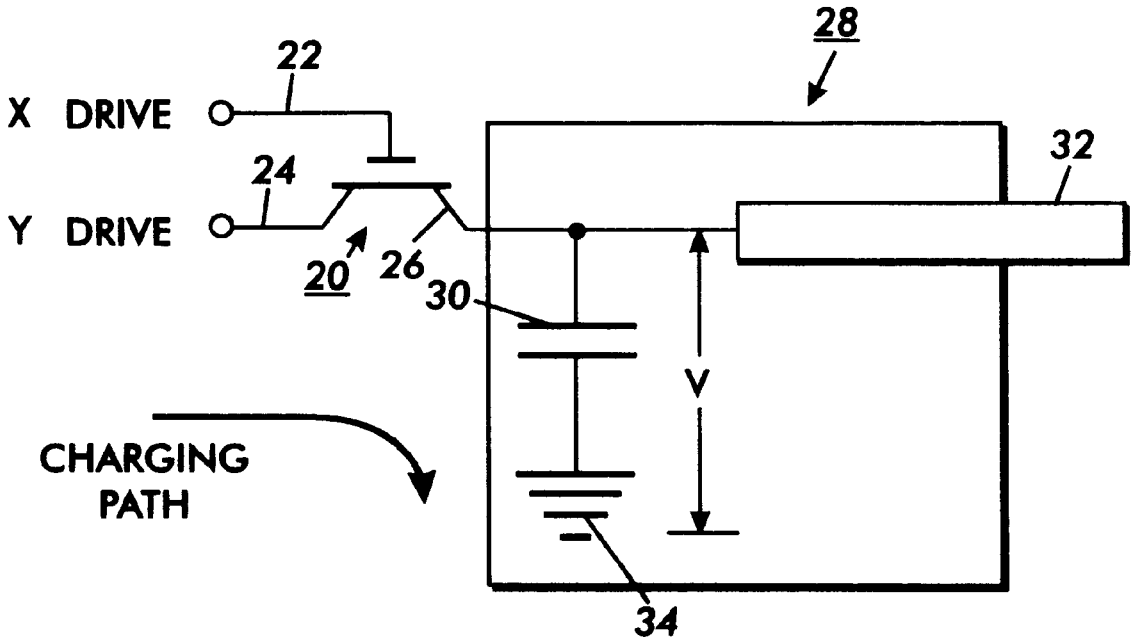
FIG. 1 schematically illustrates components producing a single pixel according to the principles of the present invention.

For a general understanding of the features of the present invention, reference is made to the drawings. In the drawings, like reference numerals have been used throughout to designate identical elements. FIG. 1 schematically depicts components producing a single picture-element, or pixel, according to the principles of the present invention. It will become evident from the following discussion that a matrix addressable surface potential comprised of a plurality of these pixel producing components is possible. Moreover, such a matrix addressable surface potential array may be employed in a wide variety of devices and applications. Therefore, the present invention is not limited in its application to the particular embodiments depicted herein.

As shown in FIG. 1, the pixel producing components include a pixel pad 28 and a high voltage thin film transistor 20. The transistor 20 has a gate electrode 22 connected to an X DRIVE line, a source electrode 24 connected to a Y DRIVE line, and a drain electrode 26 connected to both a thin film capacitor 30 and a conductor 32 contained in the pixel pad 28. As shown in FIG. 1, a reference potential 34 is at ground potential.

Briefly stated, the transistor 20 uses the gate electrode 22 to control the flow of charge carriers from the source electrode 24 to the drain electrode 26. The transistor 20 is beneficially of the type that switches well in excess of 400 volts when properly biased by a gate potential at least an order of magnitude lower than the source to drain potential. At zero voltage on the gate electrode 22, little charge passes from the source electrode 24 and the drain 26 electrode. As a gate bias of a proper polarity is applied, charge carrier flow increases as the resistivity the channel between the source electrode 24 and the drain electrode 26 is reduced. When the X DRIVE line has a sufficient positive bias the transistor 20 fully turns on and the capacitor 30 charges to a voltage V that is equal to the Y DRIVE voltage. The conductor 32 conveys the potential of the capacitor 30 out of the pixel pad 28.

Figure 2:
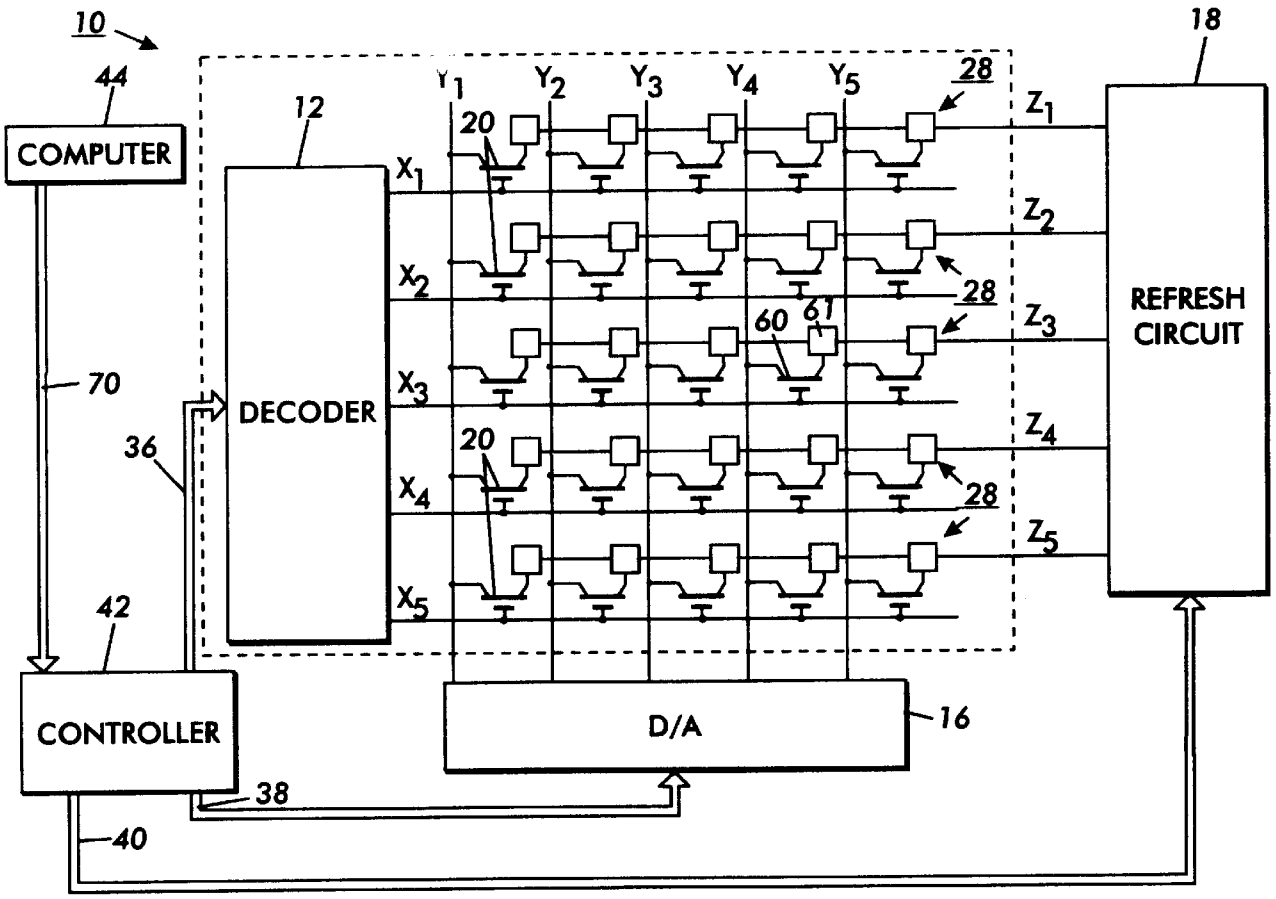
FIG. 2 is a block diagram of a matrix addressable surface potential array and associated control circuitry in accordance with the present invention.

When multiple elements according to FIG. 1 are arranged into a matrix and used in conjunction with an image input from a computer or a scanner, a digital electrophotographic printing machine can result. Such a matrix, called a surface potential array is shown in FIG. 2. It should be understood that the surface potential array of the present invention may be utilized in black and white printing as well as in a multicolor printing.

As shown, FIG. 2 illustrates an array 10 arranged in a rectangular matrix of 5 rows and 5 columns. Those skilled in the art will appreciate that for an 8.5-inch by 11-inch array having a resolution of 300 spots per inch, the array 10 would have 8.4 million pixel cells instead of the 25 shown. The array 10 generates latent images from digital information supplied to a controller 42 by a computer 44. The digital information is composed of pixel locations and pixel voltages conveyed to the controller 42 over a bus 70. The controller 42 controls the operation of the array 10 through a plurality of interface devices including a decoder 12, a refresh circuit 18, and a digital-to-analog (D/A) converter 16.

The individual pixel cells in array 10 are selected by their row and column locations so as to produce a latent image. Rows X1–X5 are selected by pixel locations sent by the controller 42 to the decoder 12 on a bus 36. The D/A converter 16 receives digitized pixel voltages from controller 42 on bus 38 and converts them to analog voltages which are placed on the selected column Y1–Y5. The refresh circuit 18 serves to recharge the latent image by receiving address data over bus 40 from controller 42 to select rows Z1–Z5. The refresh circuit 18 operates in a fashion similar to memory refresh circuits used to recharge capacitors in dynamic random access memories (DRAMs).

In FIG. 2, each pixel pad 28 is connected to a high voltage thin film transistor 20 and includes high voltage capacitor 30 in contact with a marking electrode as described in FIG. 1. It has been found that semiconductor materials, such as amporhous silicon (a-Si:H), are well suited to the desired operational and fabrication characteristics of the high voltage transistors. In view of the relatively inexpensive fabrication costs of both active and passive thin film devices over large area formats (for example, upon glass, polyimide, or other suitable substrates), it is possible to provide a cost effective surface potential array 10. Furthermore, the surface potential array 10 can incorporate high voltage thin film transistors 20 on the same integrated circuit as the high voltage capacitors and decoder 12.

In operation, it is first necessary to set up the latent image on array 10 by supplying image information to the pixels cells forming the image. Still referring to FIG. 2, assume that the pixel located at the intersection of row $X_3$ and column $Y_4$ should be charged to form an image. To charge the $X_3$, $Y_4$ pixel, a code of binary digits selects the row. Specifically, in the embodiment of FIG. 2, a binary code is sent to the decoder 12 from the controller 42. This applies a gate bias voltage to the high voltage transistors 20 on row $X_3$. Next, the digitized pixel voltage sent by computer 44 to controller 42 is conveyed to the D/A converter 16. The D/A circuit 16 produces an analog output corresponding to the value of the digital input and places it on the source electrodes of the high voltage transistors connected to column $Y_4$. As shown in FIG. 2, only one of the high voltage transistors, generally indicated by the reference numeral 60 is turned ON by the combination of the $X_3$ gate bias voltage and the voltage on column $Y_4$. Therefore, the analog voltage only appears at the drain of transistor 60 and charges the high voltage capacitor contained in the pixel pad indicated by reference numeral 61. When there is an image larger than a single pixel, the process is repeated for each subsequent pixel until the desired latent image is produced. Over time the capacitors will begin to discharge. To preserve their charge, each pixel cell must be refreshed by the refresh circuit 18.

Figure 3:
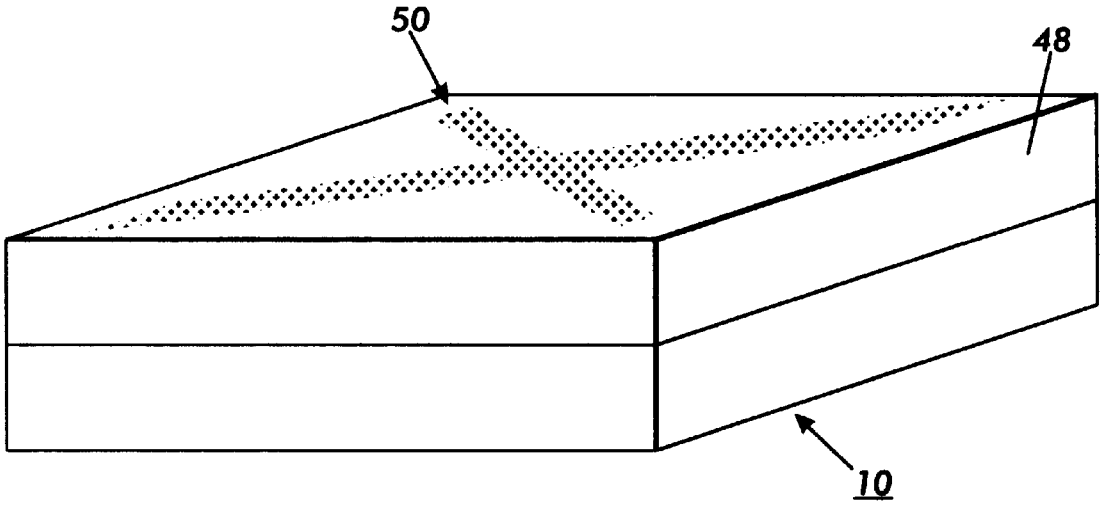
FIGS. 3 schematically illustrates the matrix addressable surface potential array of FIG. 2 mounted on a non-conductive layer and producing a latent image.

FIGS. 3–6 illustrate the printing of an electrostatic image formed by the surface potential array 10 of the present invention. To develop the latent image pattern, it is possible to deposit toner on the drain electrodes of the high voltage transistors with a grounded development system. While this is feasible, it is not desirable because the transistors in all likelihood will be damaged by the steps of development and cleaning. To avoid direct contact between the transistors and any development material, FIG. 3 shows a non-conductive layer 48 (made from glass, polyimide, or other electrically insulating materials) mounted over the surface potential array 10. The layer 48 contains a plurality of feed-through marking electrodes 32 (shown in FIG. 1) embedded therein to convey the latent image 50 from the array 10. Typically, the marking electrodes convey electrically charged surface potentials in the range of approximately 100 volts to 1000 volts.

Figure 4:
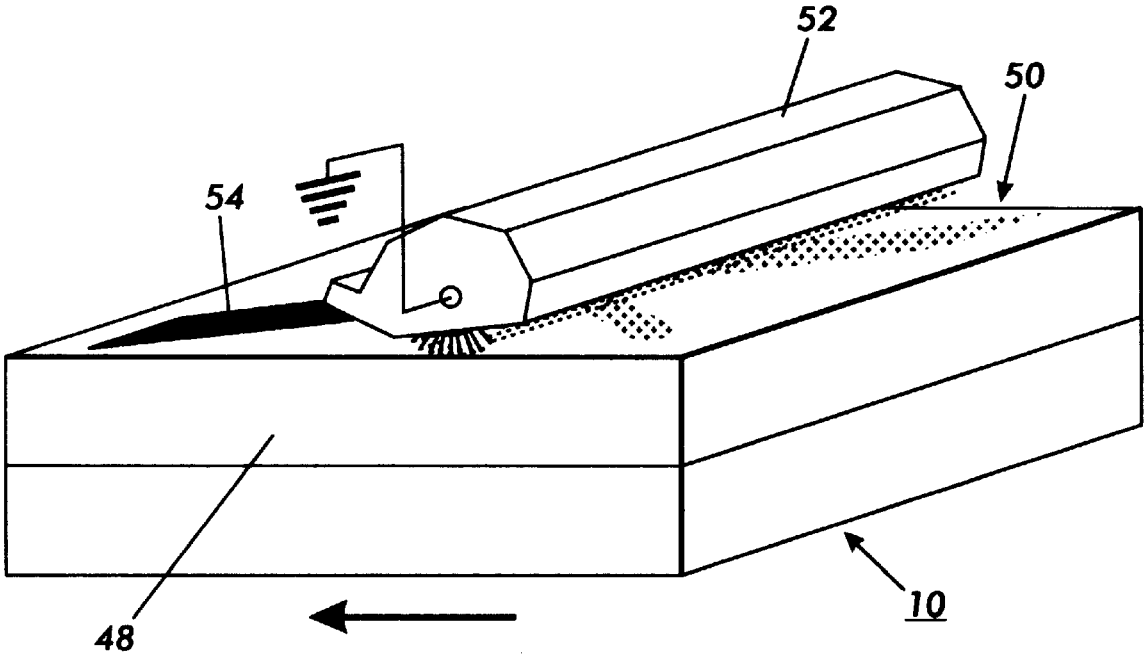
FIG. 4 schematically illustrates the process step of developing an image recorded on the matrix addressable surface potential array.
Figure 5:
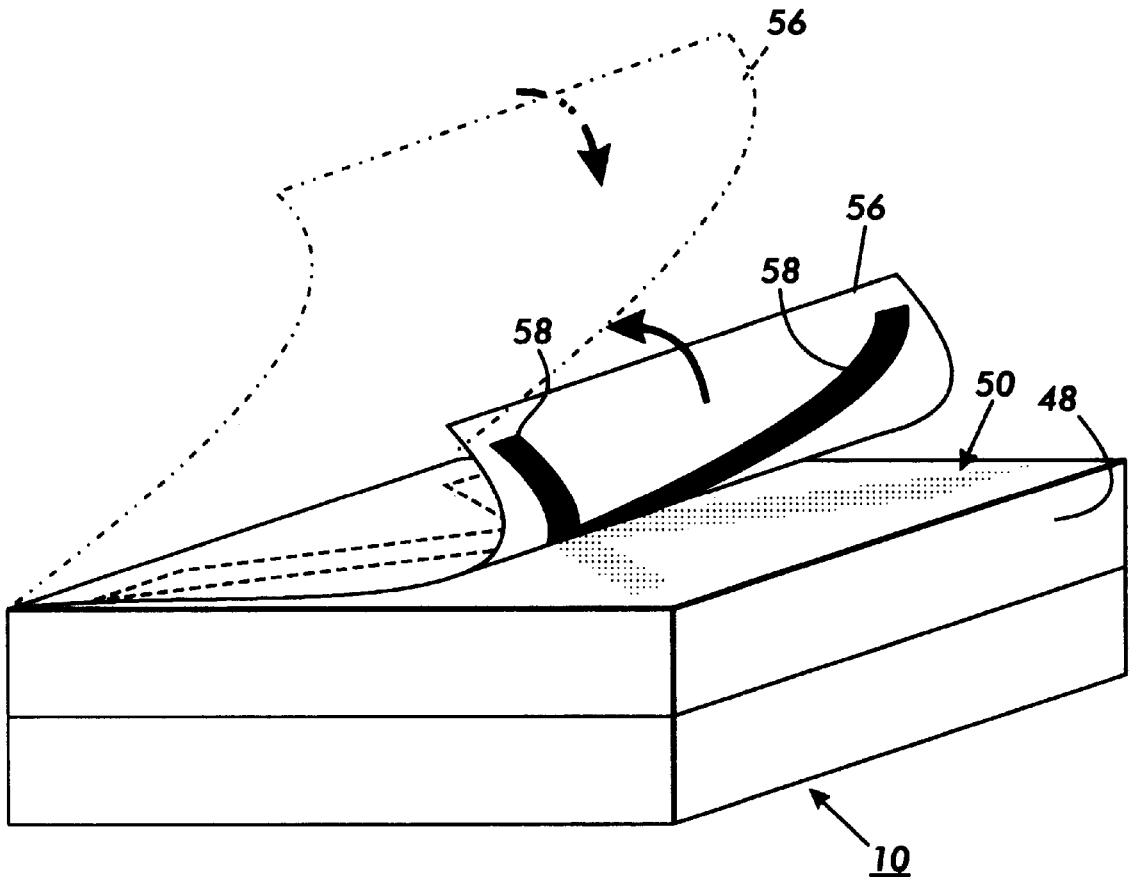
FIG. 5 schematically illustrates the step of transferring the developed image to a copy sheet.
Figure 6:
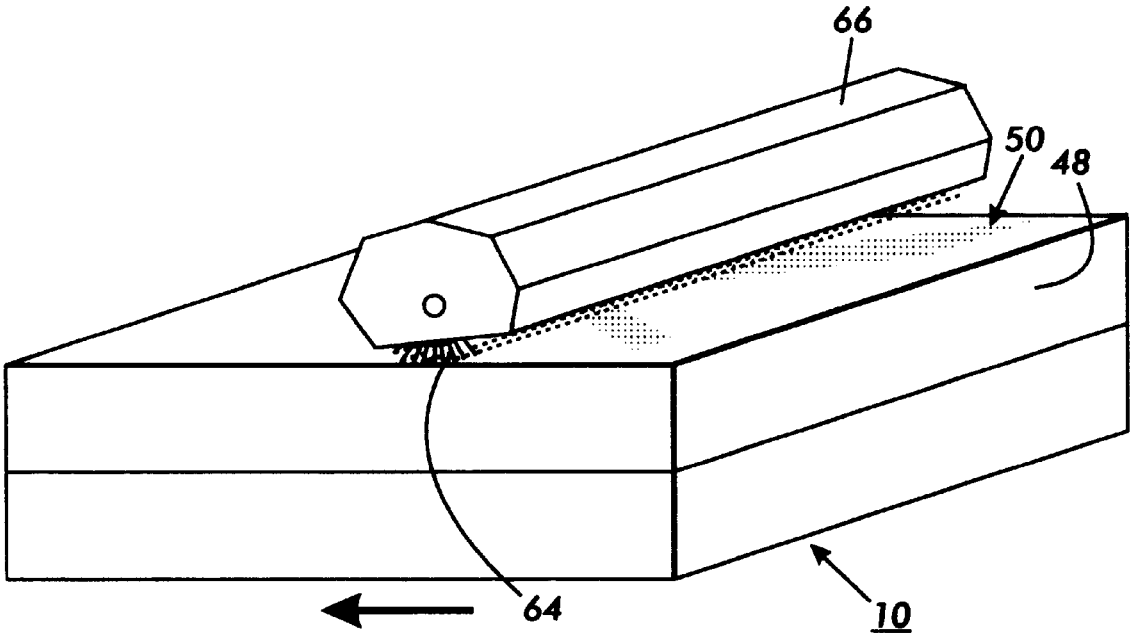
FIG. 6 schematically illustrates the step of cleaning the matrix addressable surface potential array.

In FIG. 4, the latent image 50 on the non-conductive layer is developed by a magnetic brush development system 52. The magnetic brush developer system 52 transports a developer material of carrier granules having toner particles adhering triboelectrically thereto into contact with the latent image 50. Toner particles are attracted from the carrier granules to the latent image 50 forming a toner powder image 54 on non-conductive layer 48. Next, in FIG. 5, a copy sheet 56 is moved into contact with the toner powder image. A corona generating device (not shown for clarity) applies electrostatic transfer charges onto the underside of substrate 56 to attract the toner image 58 thereto. Finally, in FIG. 6, residual toner remaining on non-conductive layer 48 is removed after the copy sheet 56 is separated from the non-conductive layer 48. The toner is removed using a cleaning brush structure 64 contained in a housing 66.

Since each pixel can be charged to a voltage of $V_{pixel}$, each pixel can have a charge set to $Q_{pixel}=CV_{pixel}$. Accordingly, if each toner particle has a charge "q", then it will take "n" toner particles to neutralize the charge $Q_{pixel}$ wherein, $nq=Q_{pixel}$. Thus, it is possible to vary the number of toner particles on a pixel-by-pixel basis to enable gray scales.

Figure 7:
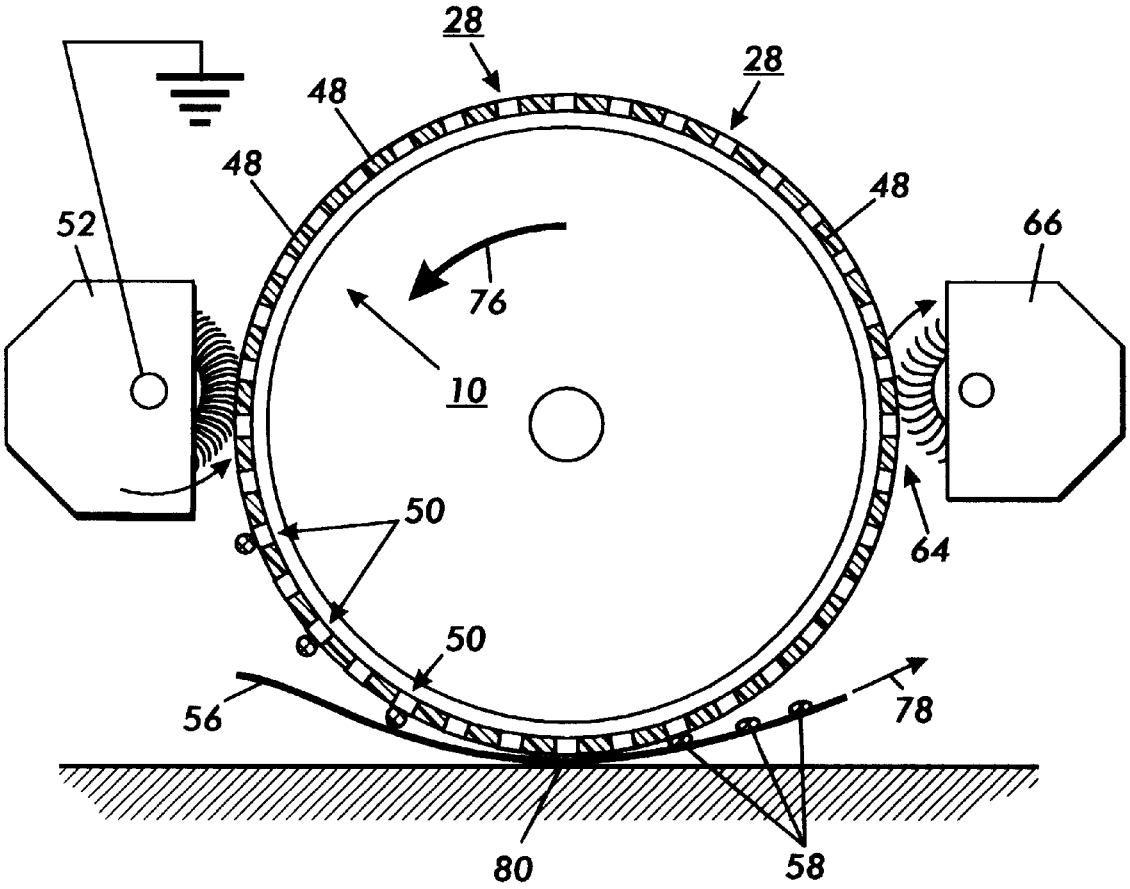
FIG. 7 schematically illustrates the matrix addressable surface potential array of FIG. 2 having a cylindrical geometry.

FIG. 7 schematically illustrates the matrix addressable surface potential array 10 having a cylindrical geometry to develop a latent electrostatic image formed thereon. The matrix addressable surface potential array 10 rotates in a direction illustrated by arrow 76 so that the latent image 50 on the non-conductive layer 48 is developed by the magnetic brush development system 52. Next, the copy sheet 56 moves into contact with the toner powder image at a transfer station 80. A corona generating device (not shown for clarity) applies electrostatic transfer charges onto the underside of the copy sheet 56 to attract the toner image 58 thereto as copy sheet 56 separates from the non-conductive layer 48, in a direction of arrow 78. Any residual toner remaining on the non-conductive layer 48 is removed by the cleaning brush 64 contained in the housing 66.

While the present invention has been described with reference to a particular embodiment, this particular embodiment is intended to be illustrative, not limiting. Various modifications may be made without departing from the spirit and scope of the invention as defined in the appended claims.

What is claimed:

1. An apparatus for forming an image, comprising:

a substrate;

a plurality of transistors on said substrate, each transistor including a source electrode, a drain electrode and a gate electrode, each of said transistors being capable of switching a marking potential between said source and said drain by the application of a gate potential to said gate;

a plurality of capacitors on said substrate, each capacitor connected to one of said drain electrodes, each;

a first data input on said substrate for selectively applying a gate potential to said gate electrodes;

a second data input located on the periphery of said substrate for selectively loading a source potential on said source electrodes;

a third data input located on the periphery of said substrate for selectively refreshing the charge potential on capacitors; and wherein said capacitors, said transistors, and said first data input, being thin film elements integrally formed on said substrate.

2. The apparatus of claim 1, further including a plurality of marking electrodes embedded in a non-conductive layer covering said substrate, a first end of each marking electrode connected to one of said capacitors, and a second end of each marking electrode terminated flush with a top surface of said non-conductive layer to convey said marking potential thereto in the form of a latent image.

3. The apparatus of claim 2, further including a station in contact with said non-conductive layer for applying developer material to said latent image to form a developed image.

4. The apparatus of claim 3, further including a station in contact with said non-conductive layer for transferring said developed image to a copy sheet.

5. The apparatus of claim 1, wherein said second data input is received by a digital to analog converter which converts said second data input into said charge potential so as to control a toner mass on each of said high voltage capacitors.

6. The apparatus of claim 5, wherein said second data input represents a gray scale intensity.

7. The apparatus of claim 1, wherein said first data input is a decoder.

8. The apparatus of claim 1, wherein said substrate is a flat panel.

9. The apparatus of claim 1 wherein said substrate is a cylinder.

10. An apparatus for forming an image, comprising:

a substrate;

a plurality of transistors on said substrate, each transistor including a source electrode, a drain electrode and a gate electrode, each of said transistors being capable of switching a marking potential on said source to said drain by the application of a gate potential to said gate;

a plurality of capacitors on said substrate, each capacitor connected to one of said drain electrodes, each capacitor being capable of storing a charge potential approximately equal to said marking potential;

a first data input on said substrate for selectively applying a gate potential to said gate electrodes;

a second data input located on the periphery of said substrate;

a digital to analog converter for receiving signals on said second data input and for converting said second data input signals into marking potential on said source electrodes; and wherein said capacitors, said transistors, and said first data input are thin film elements integrally formed on said substrate.

11. The apparatus of claim 10, wherein said second data input represents a gray scale intensity.

12. The apparatus of claim 10, further including a plurality of marking electrodes embedded in a non-conductive layer covering said substrate, a first end of each marking electrode connected to one of said capacitors, and a second end of each marking electrode terminated flush with a top surface of said non-conductive layer to convey said marking potential thereto in the form of a latent image.

13. The apparatus of claim 12, further including a station in contact with said non-conductive layer for applying developer material to said latent image to form a developed image.

14. The apparatus of claim 12, further including a station in contact with said non-conductive layer for transferring said developed image to a copy sheet.

15. The apparatus of claim 10, wherein said first data input is a decoder.

16. The apparatus of claim 10, wherein said substrate is a flat panel.

* * * * *